US005104490A

United States Patent [19]

Brinkman et al.

[11] Patent Number: 5,104,490

[45] Date of Patent: Apr. 14, 1992

[54] APPARATUS FOR CONVERTING WASTE MATERIAL TO GASEOUS AND CHAR MATERIALS

[75] Inventors: Glen Brinkman, Kearney, Nebr.; Harold Massner; Richard J. Taeger, both of Burlington, Iowa

[73] Assignee: W.E.R.E. International Inc. of Iowa, Burlington, Iowa

[21] Appl. No.: 262,126

[22] Filed: Oct. 25, 1988

Related U.S. Application Data

[60] Continuation of Ser. No. 113,398, Oct. 26, 1987, abandoned, which is a division of Ser. No. 615,187, May 30, 1984, abandoned.

[51] Int. Cl.[5] ..... C10B 1/04

[52] U.S. Cl. ..... 202/99; 202/215; 202/254

[58] Field of Search ..... 202/99, 215, 262, 254, 202/121; 201/32, 34; 55/468; 48/111, 85.2; 432/100

[56] References Cited

U.S. PATENT DOCUMENTS

| | | | |
|---|---|---|---|
| 1,510,730 | 10/1924 | Wilcox | 201/34 |
| 1,651,647 | 12/1927 | Trumble | 202/254 |
| 2,289,917 | 7/1942 | Lambiotte | 201/34 |
| 2,406,509 | 8/1946 | Pilo | 201/43 |
| 2,549,117 | 4/1951 | Nelson | 201/4 |
| 2,589,109 | 3/1952 | Martin et al. | 201/23 |
| 2,735,805 | 2/1956 | Mora | 201/34 |
| 2,743,217 | 4/1956 | Silsby | 201/36 |
| 3,139,331 | 6/1964 | Boudreau | 55/468 |
| 3,298,928 | 1/1967 | Esterer | 201/4 |
| 3,314,767 | 4/1967 | Bernstein | 422/146 |
| 3,841,851 | 10/1974 | Kaiser | 48/111 |
| 3,841,992 | 10/1974 | Jones et al. | 201/34 |
| 3,875,077 | 4/1975 | Sanga | 252/425 |
| 3,929,585 | 12/1975 | Grimmett | 201/2.5 |
| 3,956,076 | 5/1976 | Powell, Jr. et al. | 264/14 |
| 3,970,524 | 7/1976 | Funk | 201/2.5 |
| 4,029,550 | 6/1977 | Mitsui et al. | 201/2.5 |
| 4,082,615 | 4/1978 | Komuro et al. | 201/12 |
| 4,101,263 | 7/1978 | Lumpkin, Jr. | 432/13 |
| 4,157,245 | 6/1979 | Mitchell et al. | 48/197 R |
| 4,164,397 | 8/1979 | Hunt et al. | 48/209 |
| 4,204,906 | 5/1980 | Liu | 162/6 |
| 4,230,602 | 10/1980 | Bowen et al. | 252/421 |
| 4,261,795 | 4/1981 | Reilly | 202/118 |
| 4,336,131 | 6/1982 | Schmidt et al. | 48/111 |
| 4,419,185 | 12/1983 | Bowen et al. | 201/34 |

OTHER PUBLICATIONS

Robert S. Aries, "Recent Developments in the Production of Charcoal and By-Products", *Wood Distillation*, Apr. 1947, pp. 30–37.

*Primary Examiner*—Joye L. Woodard

*Attorney, Agent, or Firm*—Hill, Van Santen, Steadman & Simpson

[57] ABSTRACT

Apparatus for thermally decomposing municipal waste to produce condensable gases, char, and non-condensable gases has a vertically extending reaction chamber receiving the waste particles at the upper end, discharging char at the lower end, and receiving a hot gas at the lower end for upward flow through descending waste particles in the chamber. A dual function cone suspended at the upper end of the chamber receives the waste particles therearound, receives the gases therein and funnels the gases to a combined inlet-outlet having an inlet portion receiving a propelling air stream, an intermediate section communicating with the top of the cone and an outlet portion discharging the air and gases from the cone.

1 Claim, 2 Drawing Sheets

42
18
14
50
3
48
34
32
3
38
40
36
12
52
10
AIR IN
28
54
24
2
2
16

12
34
32
48
36
52

12
54
24
52

APPARATUS FOR CONVERTING WASTE MATERIAL TO GASEOUS AND CHAR MATERIALS

RELATED APPLICATIONS

This application is a continuation of application Ser. No. 113,398 filed Oct. 26, 1987, which is a division of application Ser. No. 615,187 filed May 30, 1984, both of which are abandoned.

BACKGROUND OF THE INVENTION

The disposition of solid municipal waste has been and continues to be an increasingly serious problem. Heretofore such waste has been disposed by use as landfill and by incineration. Up to now neither of these methods of waste disposal has been completely satisfactory. Landfill has not always been satisfactory because the materials are not always biodegradable and because of the expense and ever diminishing availability of land for this purpose. Incineration of municipal waste has not been completely satisfactory due to the required expense and lack of financial return.

SUMMARY OF THE INVENTION

With the foregoing in mind and the further knowledge that landfills cost hundreds of millions of dollars, it is understood that a more efficient apparatus for converting municipal waste into a useful product and therefore a more profitable financial return is necessary. The present invention has been conceived with the understanding that carbonaceous solids in the waste can be chemically changed by heating in the absence of air to thereby convert the municipal waste into valuable products such as carbon, oil, and gas with by-products such as metals and glass which become sterilized in the process.

It is thus an object of this invention to provide apparatus for thermally decomposing small bits and pieces of carbonaceous solids in such a manner that a maximum amount of condensable gases are automatically produced along with non-condensable gases and char.

A further object of the invention is to provide a design for an extremely simple apparatus in which the process can be carried out.

Still another object of the invention is to provide a design which can be scaled up or down in capacity without substantially changing the effectiveness of the apparatus.

Yet another object of this invention is to provide a design which is relatively inexpensive when compared to other apparatuses disclosed in the prior art for production of gaseous products and char from the thermal decomposition of carbonaceous solids.

Moreover, this invention relates to a apparatus for thermally decomposing carbonaceous solids in a reaction zone to produce non-condensable gases, maximum condensable gases, and char.

The apparatus includes a vertical reaction zone which is insulated to prevent the loss of heat through the walls thereof. The reaction zone, preferably has a circular cross section, but may be of any other suitable cross section. The reaction zone is quite tall, being in the range of 15 to 50 feet in height.

The lower end of the reaction zone is open and includes means connecting and sealing it to auxiliary equipment for handling the char and a regulated source of hot gaseous heat transfer media which has no free oxygen therein. The regulated hot gaseous heat transfer media flows into the lower end of the reaction zone which is referred to as the gas inlet end or solids outlet end. Thus, a hot regulated updraft is provided inside of the reaction zone.

The hot gaseous heat transfer media flows up and through the reaction zone and out of the upper end which is open and provided with means connecting and sealing it to auxiliary equipment for further processing of the gaseous products and for introducing the carbonaceous solids into the reaction zone.

Auxiliary equipment is provided for sprinkling cold fresh pieces of carbonaceous solids into the top of the reaction zone in such a manner that the individual pieces will become well spaced and will fall by the pull of gravity countercurrently down through the updraft of hot gaseous heat transfer media.

As the pieces of carbonaceous solids fall through the reaction zone, they are dried and then decomposed by heat to form gaseous products and char.

The char continues to fall countercurrently to the bottom end of the reaction zone where it enters auxiliary equipment to cool and remove it for further processing.

The gaseous products are swept co-current up with the hot gaseous heat transfer media as soon as they are formed. The water vapor from the drying phase is likewise swept away. The hot gaseous products mix with the hot gaseous heat transfer media and flow to the top end of the reaction zone where the gases enter auxiliary equipment which carries them away for further processing.

As the hot gases flow up through the reaction zone, the gases are cooled by giving up heat to the carbonaceous pieces which are falling countercurrently through the gases; thus, the condensable gases are cooled to a temperature below their cracking temperature which thereby minimizes subsequent cracking.

Conversely, the falling pieces of carbonaceous solids are dried and heated to their decomposition temperature; thus, after equilibrium has been reached, there is a temperature gradient formed inside the reaction zone where the temperature at the gas inlet end is considerably greater than the temperature at the gas outlet end.

BASIC PREMISES AND DEFINITIONS OF THE INVENTIVE CONCEPT

In order to grasp the disclosed inventive concept, the reader should understand that thermal decomposition shall hereinafter refer to the change of state, chemical change, and the change in properties brought about in carbonaceous solids by heating in the absence of free oxygen to convert the carbonaceous solids into three kinds of products as follows:

(1) Non-condensable gases such as carbon monoxide, hydrogen, and methane with nitrogen mixed in if air is used as a source of free oxygen;

(2) Condensable gases that condense into liquid products such as tars, oils, alcohols and many other chemicals too numerous to list; and (3) A porous solid called porous carbon, charcoal, or char.

Carbonaceous waste is derived from formerly living matter. All kinds of plants and animals are turned into products that we use and then discard. A carbonaceous solid shall hereinafter mean a substance such as wood, cellulose, paper, plastic, rubber, manure, or anything obtained from something that once lived provided that the moisture content is less than 40% by weight, unless otherwise stated.

Some kinds of carbonaceous solids, such as paper, may have non-carbonaceous solids, like clay, blended into it, and pieces of carbonaceous solids may be mixed with pieces of non-carbonaceous solids such as in the case of solid municipal waste having pieces of paper, wood, grass, plastic, rags, and food mixed with pieces of glass, metal, bone, and dirt.

Carbonaceous solids may be prepared for thermal decomposition by removing the large, thick, and heavy pieces of non-carbonaceous solids and by milling the carbonaceous solids along with the remaining pieces of non-carbonaceous solids into a finely divided condition which,in the case of solid municipal waste, resembles ground-up paper. In order to produce the maximum quantity of condensable gases, the pieces of finely divided carbonaceous solids should be as uniform in size and thickness as possible and as small and thin as practical. Hereinafter it shall be taken for granted that all carbonaceous solids have been previously prepared in the aforesaid manner for thermal decomposition.

The molecular structure of one kind of carbonaceous solid may be different from another kind; thus, the yield and quality of products derived from one kind may be different from that obtained from another carbonaceous solid. Furthermore, the particular process used to produce various products will also influence their yield and quality.

The three kinds of products generally obtainable from carbonaceous solids are not equal in value. The non-condensable gases have heat value which cannot be stored economically; therefore, these gases must be used as they are produced or else they have no dollar value. Of the three kinds of products, the non-condensable gases probably have the least value in terms of dollars.

Char has relatively good value because it is a high heat, clean burning fuel and because it can be stored economically. Charcoal is probably the oldest and best solid fuel used,and it has a relatively high dollar value.

Condensable gases probably have the highest dollar value because the gases condense into liquids that can be fractionated to produce exotic chemicals. The oil can serve as a good fuel which can be stored economically. The dollar value of the condensable gases probably exceeds the dollar value of the other two kinds of products added together. For this reason, it is important to maximize the production of condensable gases.

Prior art processes of producing gaseous products and char by thermal decomposition of carbonaceous solids are known. However, these known processes or methods actually do not maximize the production of condensable gases in that they apparently do not function in a way to do so. An outline explaining how a process or method must function in order to maximize the production of condensable gases from the thermal decomposition of carbonaceous solids follows:

(1) Countercurrent flow shall hereinafter mean that gases flow in one direction while solid pieces flow through the gases to the opposite direction, except for dust or powder that might flow concurrently with the gases. The production of condensable gases cannot be maximized without the existence of countercurrent flow.

(2) Heat transfer—Most carbonaceous solids transfer heat so poorly that they are sometimes used as heat insulators. Therefore, forcing heat to flow by conduction through a mass of carbonaceous pieces is very inefficient, slow, and costly.

The best way of transferring heat to each piece in a mass of carbonaceous pieces is not by conduction through one piece to get to another, but by convection of hot gases around each piece. Therefore, each piece must have enough space around it for enough hot gaseous media to flow. Thus, the pieces can absorb heat by radiation and convection from the hot gas as it contacts and flows around each piece, if it is cooler than the gas.

One of the functions of the hot gaseous heat transfer media is to transfer heat in as efficient, fast, and low cost manner as possible with countercurrent flow.

The main advantage associated with finely divided carbonaceous solids is that such small and thin pieces can be individually heated throughout in a few seconds (or less) if the pieces are well spaced from one another and moving countercurrently through the flow of a hot enough gaseous heat transfer media.

Another advantage of heating such small pieces in countercurrent flow is that a greater quantity of solids can be heated in a particular size of device per unit of time, thus the investment is considerably less.

The above advantages may be lost if the pieces cling together in large clusters. Therefore, the pieces must be handled in such a manner that they will be well spaced and moving countercurrently in the hot gaseous heating media.

(3) The reaction zone is a long insulated space in which the hot gases and carbonaceous solids flow countercurrently and where the carbonaceous solids are converted into gaseous products and char.

The end of the reaction zone through which the hot gaseous heat transfer media enters shall hereinafter be referred to as the gas inlet or solids outlet and the opposite end shall be referred to as the gas outlet or the solids inlet.

(4) Drying—Each piece of carbonaceous solid must be dried before it can be heated to a high enough temperature to decompose it because evaporation of water from the piece tends to cool it.

The fresh carbonaceous pieces are dried with the same gaseous heat transfer media that heats the pieces to their decomposition temperature after being dried.

The cold fresh pieces of carbonaceous solids enter the solids inlet end of the reaction zone in a well-spaced manner. The gases emerging from this end are relatively cool but hot enough to start drying the pieces as they enter. The farther the pieces travel into the reaction zone, the hotter the gas temperature becomes and the hotter the pieces become. Thus, there is a temperature gradient between the ends of the reaction zone with the hottest end being the gas inlet end and the coolest being the gas outlet end.

As the carbonaceous pieces are dried, the water vapor emerging from them is immediately swept away by the gases. Thus, there is maximum drying speed and efficiency.

The gaseous heat transfer media functions to supply heat for drying the pieces of carbonaceous solids and functions to remove the water vapors as they are formed.

Prior art discloses drying the pieces in a separate device, but this increases the complexity of operation, complexity of control, and the amount of investment.

(5) Cracking—After each piece of carbonaceous solids has been dried, it must be heated to a high enough temperature to decompose it before it leaves the reaction zone at the solids outlet end.

Thermal decomposition is the breaking-up of the larger, more complex molecules of the carbonaceous solid to form the smaller, less complex molecules of the gaseous products and char.

The breaking-up of molecules to form new molecules which are different in size, complexity, or structure is called cracking.

The products formed by cracking depends upon such conditions as the size of the piece of carbonaceous solid, the rate of heating the piece, the environment around the piece, and the presence of a catalyst.

Another function of the hot gaseous heat transfer media is to heat each dried piece of carbonaceous solid as fast as possible to crack it.

(6) Subsequent cracking—After a carbonaceous solid has been cracked and new molecules formed, the breaking-up of the new molecules into still simpler and smaller molecules is called subsequent or secondary cracking.

Generally speaking, it is more lucrative to produce the more complex and heavier condensable gases than it is to produce the simpler and lighter weight non-condensable gases. Therefore, if it is desired that a greater portion of the products be condensable gases, then subsequent cracking must be avoided because it converts condensable gases into non-condensable gases.

Hot char acts as a catalyst to promote subsequent cracking. Therefore, if subsequent cracking is to be minimized, the gaseous products that are produced should be removed from the charred pieces of carbonaceous solids as the gases emerge from them because the longer that the hot condensable gases remain in contact with the hot char, the greater the chance for subsequent cracking to occur.

Another function of the gaseous heat transfer media is to flush away the gaseous products from the hot char as the gaseous products are produced.

There should be as little lag time as possible from the time that the outermost portion of each piece is cracked until the innermost portion is cracked. Since most carbonaceous solids are poor conductors of heat, the large thick pieces cause considerable lag time and therefore cause subsequent cracking because the outermost portion of the piece becomes hot char before the gases from the innermost portion has had time to be formed and then escape through the pores in the outermost portion, which has become a hot char catalyst. Thus, subsequent cracking occurs as the condensable gases from the interior passes through the pores in the exterior. In view of the foregoing, the carbonaceous solids should be milled into as small and thin pieces as practical if a maximum amount of condensable gases are to be produced.

Furthermore, if a more stable operation is desired, then the carbonaceous pieces should be as uniform in size and thickness as possible.

(7) Cooling—Subsequent cracking can also be minimized by cooling the gaseous products a little as they are being formed.

Another function of the gaseous heat transfer media is to sweep the newly formed gaseous products immediately to a cooler part of the reaction zone while at the same time the gases are also cooled by surrendering heat to the cooler oncoming pieces of carbonaceous solids.

(8) Separating—The gaseous products must be separated from the char or the fresh pieces before condensation of the condensable gases is allowed to occur because the porous char or fresh pieces can absorb, mix with, and spoil the liquid products and the char that is involved.

This separation is automatic because of the countercurrent flow between the solids and the gases.

BRIEF DESCRIPTION OF THE DRAWINGS

Referring briefly to the drawings, the reader will readily see that.

DETAILED DESCRIPTION OF THE INVENTION

Figures 1, 2, 3:
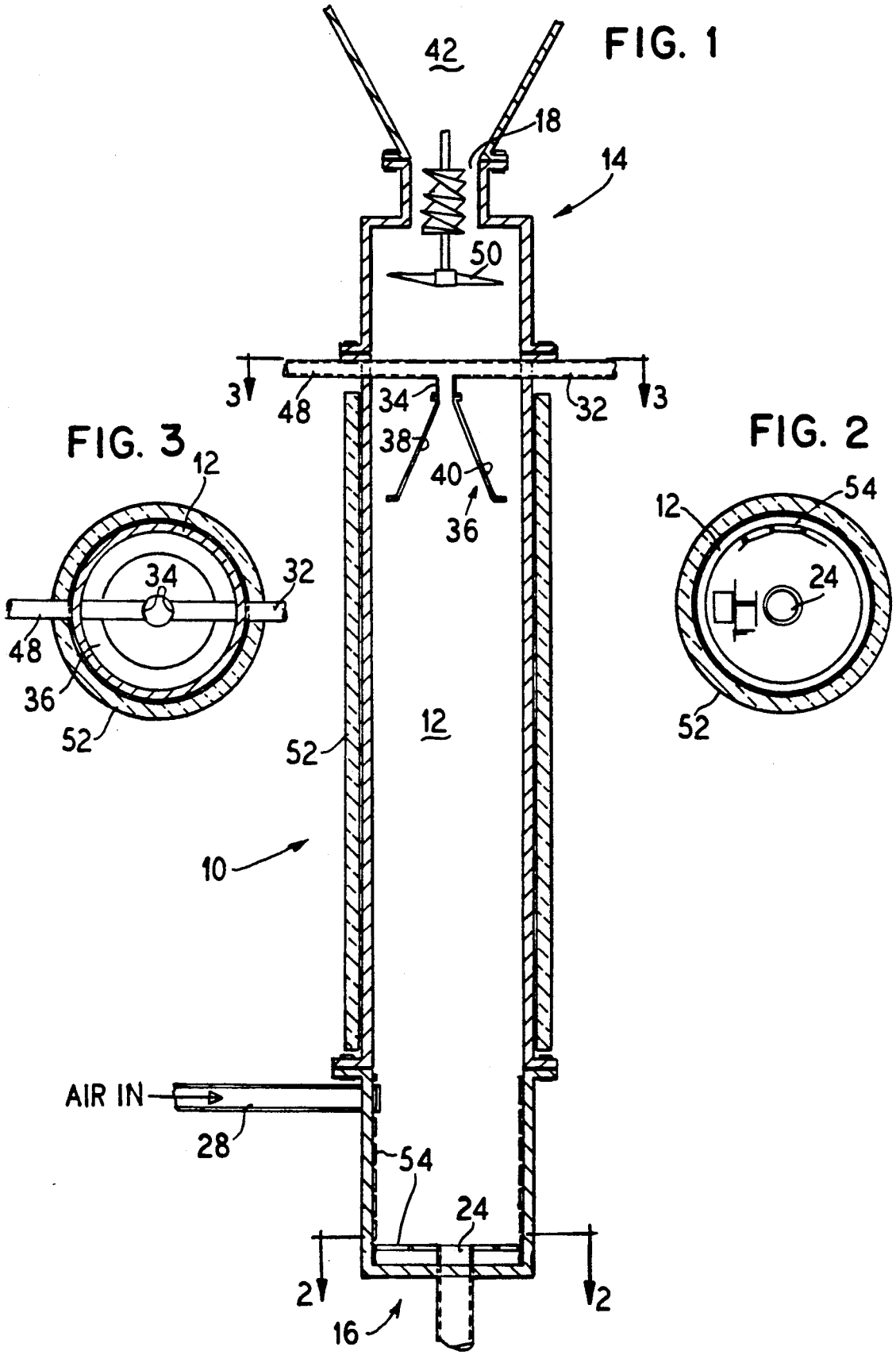
FIG. 1 represents a longitudinal cross-sectional view of a chamber or zone of an apparatus in which the process according to the disclosed invention may take place.
FIG. 2 is a view taken through section 2—2 of FIG. 1.
FIG. 3 is a view taken through 3—3 of FIG. 1.
Figure 6:
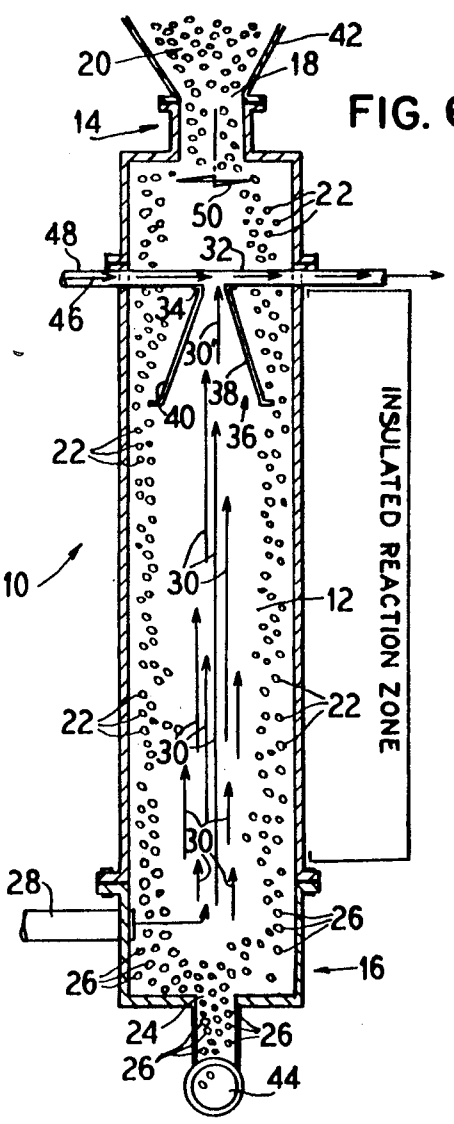
FIG. 6 is a view similar to FIG. 1 showing introduction and flow of both heated gaseous media and finely divided pieces of carbonaceous solids through the reaction zone.
Figure 5:
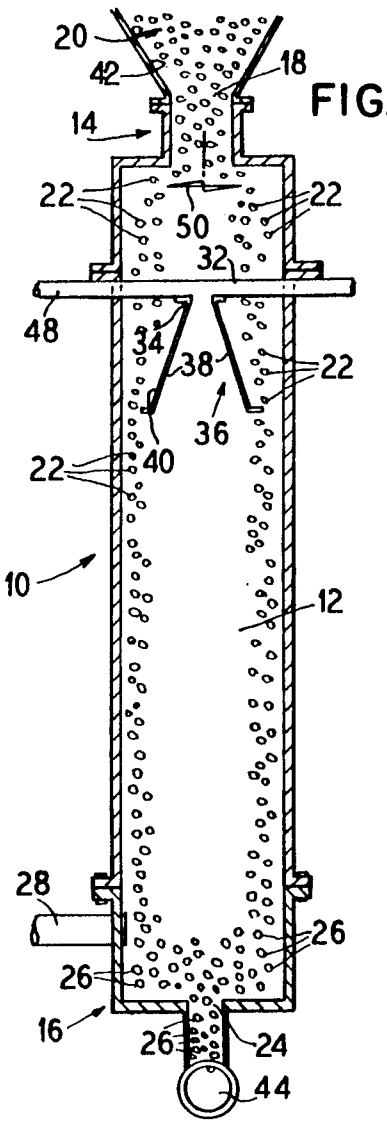
FIG. 5 is a view similar to FIG. 1 showing introduction and flow of finely divided pieces of carbonaceous solids through the reaction zone.
Figure 4:
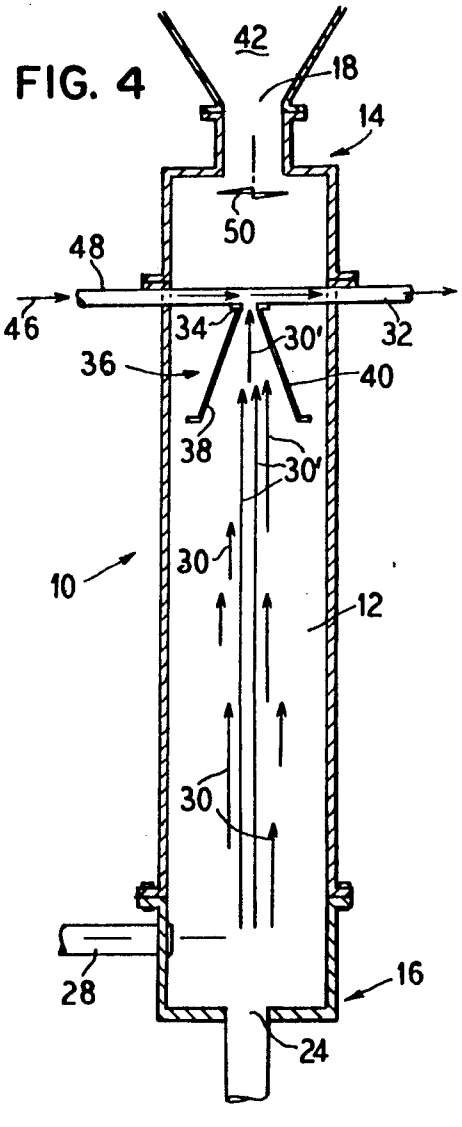
FIG. 4 is a view similar to FIG. 1 showing introduction and flow of heated gaseous media through the reaction zone.

Referring now in detail to the drawings with the above background and summary of the invention in mind, the reader should readily see from FIGS. 1, 4, 5, and 6, in particular, that the disclosed inventive concept resides in the apparatus 10 for thermally decomposing carbonaceous solids from municipal waste to thereby produce maximum gases, char, and non-condensable gases. As may be clearly visualized in FIG. 1, the apparatus 10 for decomposing municipal waste in accordance with the inventive concept disclosed and claimed herein comprises an arrangement in which there extends an elongated, generally vertical reaction chamber 12 having an upper end 14 and a lower end 16 between which municipal waste and a heated gaseous medium may pass countercurrently and in heat exchange relationship. An entrance 18 is provided at the upper end 14 of reaction chamber 12 through which municipal waste 20 in the form of finely divided pieces of carbonaceous solids 22 may be introduced and which pieces of solids 22 may ultimately gravitate through reaction chamber 12. An exit 24 is provided at the lower end 16 of reaction chamber 12 through which the char particles 26 formed in reaction chamber 12 may be discharged and removed. An inlet conduit, passage 28, or the like is provided adjacent the lower end 16 of reaction chamber 12 through which a heated gaseous medium 30 may be introduced into reaction chamber 12 for upward flow therethrough. A combined inlet/outlet arrangement has an outlet conduit or passage 32 adjacent the upper end 14 of reaction chamber 12 with has a downwardly directed extension 34 from which depends a dual functional conical member 36. The conical member 36 converges upwardly to the extension 34 so that its inward surface 38 funnels all non-condensable gases and spent heated gases 30' toward the outlet 32. The outer surface 40 of this cone 36 diverges downwardly and diverts incoming pieces of carbonaceous solids 32 toward the peripheral side wall of the reaction chamber 12 and away from the center thereof.

Also provided at the upper end 14 of reaction chamber or zone 12 is a hopper or funnel 42 in which municipal waste 20 is received and ultimately passed through entrance 18 into reaction zone 12. Another auxiliary component of apparatus 10 is an auger 44 which communicates with exit 24 at the lower end 16 of reaction chamber 12 to thereby remove solid char particles 26 from apparatus 10. To promote efficient removal of non-condensable gases and/or spent heated gaseous medium 30' air 46 under pressure, for example, may be supplied through a tube 48 or the like, the latter of which is in communication with conduit or passage 32 and the inside of cone 36.

From the above descriptions, it will be understood that the outlet conduit or passage 32, the extension 34, and the tube 48 provide a combined inlet-outlet conduit receiving the non-condensable or spent gases 30' from the conical member 36 and receiving air under pressure from the tube 48 to propel the removal of the gases through the outlet passage 32.

Also, to facilitate dispersion and reducing the size of the waste particles 20, rotary blades 50 are provided in the vicinity of entrance 18. To further ensure thermal efficiency of apparatus 10, suitable insulation 52 is provided around reaction chamber 12 and a tile liner 54 is provided on the floor and lower wall portion of the interior of apparatus 10.

After familiarizing himself with the structural details of apparatus 10 as described above, the reader, if having access to such equipment, will be in a position to carry out a process for thermally decomposing carbonaceous solids 20 from municipal waste from which maximum condensable gases, char from the thermal decomposition of the carbonaceous solids, and non-condensable gases are produced in the apparatus 10 or like arrangement. The process comprising the steps of introducing a regulated stream of hot non-oxidizing, heat transferring gaseous media 30 into a tall vertical reaction zone 12 at or adjacent the bottom or lower end 16 thereof in such a manner that the gaseous media 30 will flow throughout the cross section and height of the reaction zone 12, thereby providing a flow controlled heated updraft therein; introducing finely divided pieces 22 of carbonaceous solids, which may be preprocessed into suitably small pieces, into the top of the reaction zone 12 in such a manner that the pieces of carbonaceous solids 22 will fall well dispersed and spaced throughout the cross section and depth of the reaction zone 12; regulating the velocity at which the pieces of carbonaceous solids fall through the reaction zone by controlling the flow of the updraft, thereby controlling the time that each piece 22 of carbonaceous solids resides in the reaction zone 12, as well as controlling the amount of gaseous media 30 which will pass countercurrently up and around the falling pieces 22 for heat exchanging purposes; maintaining the input temperature of the updraft at some temperature considerably greater than the decomposing temperature of the particular kind of carbonaceous solids that are involved, thereby producing both maximum condensable gases and non-condensable gases; drying the finely divided pieces 22 of carbonaceous solids with the heated updraft of gaseous media 30 as the pieces 22 fall through the upper portion of the reaction zone 12, thereby cooling the updraft 30 along with the gaseous products entrained therein while the water vapor formed by drying the pieces is swept co-currently away with the updraft 30; heating the dried pieces 22 to their decomposing temperature as they fall through the lower portion 16 of the reaction zone 12, thereby forming char 26 that continues to fall and forming gaseous products 30' that are swept away co-currently with the updraft 30 including any char dust or other products that might drift upwardly, thereby cooling the updraft in the lower portion 16 of the reaction zone 12 as heat is transferred from the gaseous heating media 30 to the dried pieces 22 of carbonaceous solids; developing a temperature gradient from the top 14 to the bottom 16 of the reaction zone 12, whereby after equilibrium is reached, the temperature at the top 14 of the reaction zone 12 is considerably less than the temperature at the bottom 16 due to the cooling effect that the drying and heating have upon the gaseous updraft 30 which thereby indicates the condition of operation due to the temperature difference from the top 14 to the bottom 16 of the reaction zone 12 if it is well insulated; removing the char 26 and non-carbonaceous solids that have fallen to the bottom 16 of the reaction zone 12 for further processing or use; and removing the non-condensable gases, condensable gases, water vapors, char dust, the gaseous heat transfer media 30', and any other product which drifted to the top of reaction zone 12 for further processing.

Other steps or variations of the process include the steps of introducing a stream 30 of hot non-oxidizing, heat transferring gaseous media into a reaction zone 12 in a given direction, for example, upwardly, introducing pieces of carbonaceous solids 22 into the reaction zone 12 from an opposite end thereof, downwardly, and in counter-current relationship to the direction of the flow of the gaseous media 30 whereby a temperature gradient system from an input temperature level adjacent the lower end 16 of apparatus 10 to an output temperature level adjacent the upper end 14 is developed between the pieces of carbonaceous solids 22 and the gaseous media 30; maintaining the heated gaseous media 30 at an input temperature sufficiently greater than that required for decomposition of the carbonaceous solids 22 so that the process will reach equilibrium conditions with the temperature gradient of the heated gaseous media 30 ranging from its input temperature to a reduced output temperature so that pieces of carbonaceous solids 22 passing in contact with the heated gaseous media 30 through an initial reaction zone 12 adjacent its reduced output temperature at upper end 14 are subjected to a drying effect, thereby cooling the gaseous media 30 along with gaseous products entrained therein and with water vapor formed in the drying effect being swept concurrently with the gaseous media 30' and the pieces of carbonaceous solids 22 after being subjected to the drying effect are passed to an intermediate reaction zone 12 at such a temperature level sufficient to produce char 26 and gaseous products 30' including maximum condensable gases and non-condensable gases.

The inventive concept may further be denominated as an apparatus for thermally decomposing carbonaceous solids 22 from municipal waste from which maximum condensable gases, char from the thermal decomposition of the carbonaceous solids, and non-condensable gases are produced. The process includes the steps of passing pieces of carbonaceous solids 22 from municipal waste through a reaction zone 12 in a given direction, downwardly, for example, in heat exchange relationship with and countercurrently to a heated gaseous medium 30 passing in an opposite direction,upwardly, whereby a temperature gradient system is developed between an input temperature and an output temperature of the gaseous medium 30; and maintaining the heated gaseous medium 30 at an input temperature level equal to or considerably greater than that required for decomposition of the carbonaceous solids to produce char, maximum condensable gases, and non-condensable gases 30'.

Additionally, the process may also include the steps of reducing the municipal waste to finely divided pieces 22 of carbonaceous particles before introduction thereof into the reaction zone 12, and removing the char and any non-carbonaceous solids obtained in the process, and providing that the reaction zone 12 through which the pieces of carbonaceous solids 22 and the heated gaseous medium 30 pass in heat exchange relationship and countercurrently extends generally vertically for a substantial distance with the pieces 22 of carbonaceous solids being introduced into the reaction zone 12 adjacent the upper end 14 thereof and the heated gaseous medium being introduced into the reaction zone adjacent the lower end 16 thereof.

It will be obvious to those skilled in the art that various changes may be made without departing from the scope of the invention and the invention is not to be considered limited to what is shown in the drawings and described in the specification.

What is claimed is:

1. Apparatus for thermally decomposing municipal waste to produce gases and char which comprises an elongated upstanding reaction chamber having an inside wall with an upper end and a lower end between which municipal waste and a heated gaseous medium may pass countercurrently and in heat exchange relationship, an entrance at the upper end of said reaction chamber, means introducing municipal waste in the form of finely divided pieces of carbonaceous solids through said entrance for falling through the chamber, an exit at the lower end of the chamber for discharging char particles, means for introducing a heated gas adjacent the lower end of the chamber for upward flow therethrough around said pieces to form said char, a combined inlet-outlet conduit at the upper end of the chamber with an inlet section, and outlet section and an intermediate section, said inlet section extending from outside said chamber into the chamber adjacent the upper end thereof, said outlet section extending from inside said chamber to the outside of the chamber adjacent said upper end of the chamber, said intermediate section extending as a downwardly directed open tubular extension from and in communication with said inlet and outlet section of said conduit, a dual function cone in the upper end portion of the reaction chamber converging to a small upper end and having an inner surface and an outer surface spaced from the inside wall of the chamber, means connecting the small upper end of the cone to the open tubular extension of said combined inlet-outlet conduit whereby the inner surface of the cone converges upwardly to funnel gases from the reaction chamber to the inlet-outlet conduit, means supplying a pressurized gaseous media through the inlet section of said conduit for propelling gases from the intermediate section through the outlet section of the conduit, outer surface of the cone receiving therearound the pieces of carbonaceous solids from said entrance at the top of the reaction chamber to divert the pieces toward the inside wall of the reaction chamber to gravitate downwardly to the lower end of the chamber in countercurrent flow to the heated gas introduced adjacent the lower end of the reaction chamber and enveloped by said gas, and rotary blade means between the entrance and the inlet-outlet conduit communicating with the upper end of said reaction chamber for facilitating dispersion of the carbonaceous solids pieces over the cone end into the chamber.

* * * * *